US008471775B2

(12) United States Patent
Nakabayashi et al.

(10) Patent No.: US 8,471,775 B2
(45) Date of Patent: Jun. 25, 2013

(54) ARRAY ANTENNA AND RADAR APPARATUS

(75) Inventors: Kento Nakabayashi, Anjo (JP); Kazuma Natsume, Oobu (JP); Yuu Watanabe, Toyota (JP); Takuya Kouya, Nagoya (JP)

(73) Assignee: Denso Corporation, Kariya (JP)

( * ) Notice: Subject to any disclaimer, the term of this patent is extended or adjusted under 35 U.S.C. 154(b) by 365 days.

(21) Appl. No.: 12/661,383

(22) Filed: Mar. 16, 2010

(65) Prior Publication Data

US 2010/0238067 A1 Sep. 23, 2010

(30) Foreign Application Priority Data

Mar. 18, 2009 (JP) ..... 2009-065910

(51) Int. Cl.
*H01Q 11/02* (2006.01)

(52) U.S. Cl.
USPC ..... 343/731; 342/70

(58) Field of Classification Search
USPC ..... 342/70; 343/731
See application file for complete search history.

(56) References Cited

U.S. PATENT DOCUMENTS 5,367,307 A * 11/1994 Dupuis et al. ..... 343/700 MS
6,424,298 B1 * 7/2002 Nishikawa et al. .... 343/700 MS
2002/0004692 A1 * 1/2002 Nicosia et al. ..... 701/16
2003/0184477 A1 * 10/2003 Shafai et al. ..... 343/700 MS
2004/0145513 A1 * 7/2004 Katayama et al. ..... 342/70
2005/0285773 A1 * 12/2005 Hartzstein et al. ..... 342/70

FOREIGN PATENT DOCUMENTS

| | | |
|---|---|---|
| JP | 06-112725 | 4/1994 |
| JP | 07-086826 | 3/1995 |
| JP | 08-097620 | 4/1996 |
| JP | 08-186436 | 7/1996 |
| JP | 2001-044752 | 2/2001 |
| JP | 2006-064628 | 3/2006 |
| JP | 2006-279525 | 10/2006 |
| JP | 2008-014643 | 1/2008 |
| JP | 2008-151583 | 7/2008 |

OTHER PUBLICATIONS

Office Action dated Jan. 18, 2011 from corresponding Japanese Patent Application No. 2009-065910 with English translation.

* cited by examiner

*Primary Examiner* — Timothy A Brainard
(74) *Attorney, Agent, or Firm* — Harness, Dickey & Pierce, PLC

(57) ABSTRACT

The array antenna includes a feed line, and a plurality of radiating element sections arranged at a predetermined arranging interval in a first direction, each of the radiating element sections including at least one radiating element fed a traveling wave through the feed line. The inter-element line length as a length of the feed line between each succeeding two of the radiating element sections is longer than the arranging interval in the first direction.

22 Claims, 8 Drawing Sheets

FIG.4A
| | | PHASE SHIFT [DEGREE] | | | BEAM DIRECTION |
|---|---|---|---|---|---|
| | FREQUENCY [GHz] | k | k+1 | k+2 | |
| CONVENTIONAL RADAR | 76 | 0 | 50 | 100 | −1 |
| | 76.5 | 0 | 0 | 0 | 0 |
| | 77 | 0 | −50 | −100 | 1 |
| RADAR OF INVENTION | 76 | 0 | 150 | 300 | −3 |
| | 76.5 | 0 | 0 | 0 | 0 |
| | 77 | 0 | −150 | −300 | 3 |
FIG.4B
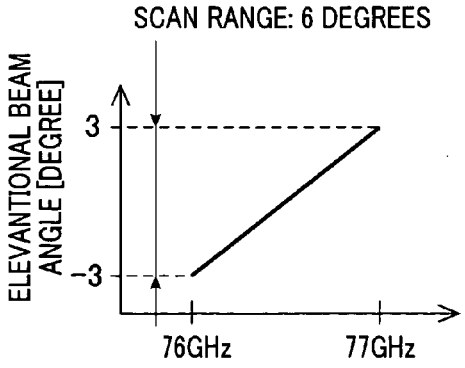
FIG.4C
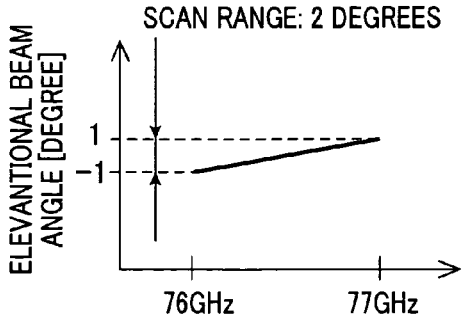

ARRAY ANTENNA AND RADAR APPARATUS

CROSS-REFERENCE TO RELATED APPLICATION

This application is related to Japanese Patent Applications No. 2009-65910 filed on Mar. 18, 2009, the contents of which are hereby incorporated by reference.

BACKGROUND OF THE INVENTION

1. Field of the Invention

The present invention relates to a traveling-wave fed array antenna, and a radar apparatus using the array antenna.

2. Description of Related Art

There is known a vehicle-mounted radar apparatus which scans ahead of a vehicle in the lateral direction (horizontal direction) of the vehicle with a radar beam to detect an obstacle or a preceding vehicle present on the traveling lane of the vehicle.

Also, as an antenna for use in such a radar apparatus, there is known a traveling-wave fed array antenna 101 having a structure shown in FIG. 8A in which a plurality of radiating elements 103 are arranged in a row, and connected in series through a feed line 105, the feed line 105 being terminated at one end thereof with a resistor to prevent a reflected wave from occurring, and being fed at the other end thereof.

Such a traveling-wave fed array antenna 101 is mounted on a vehicle plurally along the lateral direction to enable detection in a lateral plane, such that the arranging direction of the radiating elements 103 is along the vertical direction.

Incidentally, the beam direction of the traveling-wave fed array antenna 101 varies with the variation of the frequency of the traveling wave fed thereto. For example, as shown in FIG. 8B, when the arranging interval (feed line interval) D between the succeeding radiating elements 103 is equal to the on-line frequency of the fed signal (when the on-line frequency is f1 in FIG. 8B), since all the radiating elements 103 radiate radar waves having the same phase, the direction of the beam transmitted from the traveling-wave fed array antenna 101 points to the front direction (the tilt angle =0) of the radiating plane on which the radiating elements 103 are disposed. On the other hand, when the arranging interval D is different from the on-line frequency of the fed signal, since the radiating elements 103 radiate radar waves having different phases successively increasing by a constant value $\alpha$ along the arranging order of the radiating elements 103, the direction of the beam transmitted from the traveling-wave fed array antenna 101 has an inclination depending on the constant value $\alpha$ to the front direction (the tilt angle=0) of the radiating plane.

Accordingly, various methods to keep the tilt angle unchanged when the frequency of the fed signal is changed are proposed. For example, refer to Japanese Patent Application Laid-open No. 08-097620, or No. 2006-279525. Incidentally, when a radar apparatus is mounted on a vehicle, the direction, especially the elevation tilt angle of the radar beam has to be adjusted.

Such tilt angle adjustment can be carried out by manual work using a screw. It is also known to carry out the tilt angle adjustment by performing electronic signal processing such as DBF (Digital Beamforming) or MUSIC (Multiple Signal Classification). Further, it is also known to perform beam scanning in the elevation direction by use of a specific hardware device such as a dielectric lens, a Rotman lens or a Butler matrix, and set the beam transmission angle to a desired elevation tilt angle. However, performing such electronic signal processing or using such a specific hardware device causes the circuit scale and signal processing amount of the radar apparatus to increase.

Accordingly, it is proposed to electrically adjust the tilt angle making positive use of the fact that the tilt angle varies with the variation of the frequency of a fed signal. For example, refer to Japanese Patent Application Laid-open No. 2006-64628.

However, since the frequency band of a vehicle-mounted radar apparatus is limited to the narrow range (76 GHz to 77 GHz), the tilt angle can be changed only by approximately 2° at most (approximately ±1°) when its radiating elements are arranged at intervals of one wavelength of a fed signal) even if the frequency of the fed signal is varied to a maximum extent possible within the above range, which is insufficient to adjust the tilt angle sufficiently.

SUMMARY OF THE INVENTION

The present invention provides an array antenna comprising: a feed line; and a plurality of radiating element sections arranged at a predetermined arranging interval in a first direction, each of the radiating element sections including at least one radiating element fed a traveling wave through the feed line;

wherein an inter-element line length as a length of the feed line between each succeeding two of the radiating element sections is longer than the arranging interval.

The present invention also provides a radar apparatus comprising:

a transmitting antenna section to transmit a radar beam when supplied with a transmit signal;

a receiving antenna section to receive the radar beam reflected from an object and output a receive signal;

a signal generating section to generate the transmit signal to be supplied to the transmitting antenna section; and a signal processing section to process the receive signal outputted from the receiving antenna section in order to obtain information on the object;

wherein each of the transmitting antenna section and the receiving antenna section is constituted of at least one of the array antenna as recited above, and the signal processing section includes a frequency control section to control a frequency of the transmit signal.

According to the present invention, there are provided an array antenna and a radar apparatus which can adjust beam direction in a wide range without increasing a circuit scale or signal processing amount.

Other advantages and features of the invention will become apparent from the following description including the drawings and claims.

BRIEF DESCRIPTION OF THE DRAWINGS

In the accompanying drawings:

FIG. 4A is a table showing difference in performance between the array antenna of the first embodiment of the invention and a conventional array antenna; FIGS. 4B and 4C are graphs showing difference in performance between the array antenna of the first embodiment of the invention and the conventional array antenna;

PREFERRED EMBODIMENTS OF THE INVENTION

First Embodiment

F*ig*. 1A is a block diagram showing the overall structure of a radar apparatus 1 to which the present invention is applicable.

Figure 1A:
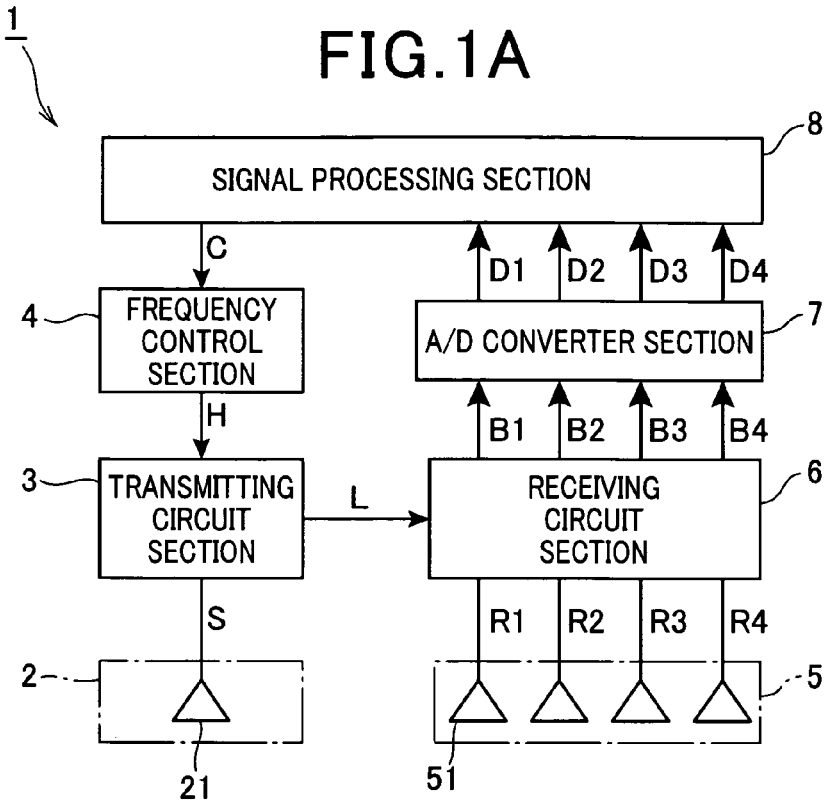
FIG. 1A is a block diagram showing the overall structure of a radar apparatus to which the present invention is applicable.

As shown in FIG. 1A, the radar apparatus 1 includes a transmitting antenna section 2, a frequency control section 4, a transmitting circuit section 3, a receiving antenna section 5, a receiving circuit section 6, an A/D converter section 7, and a signal processing section 8.

The transmitting antenna section 2 transmits a radar beam of a millimeter-wave band (76 GHz to 77 GHz, in this embodiment). The frequency control section 4 generates a high frequency signal H of the millimeter-wave band, and controls the frequency of this high frequency signal H in accordance with a control command C received. The transmitting circuit section 3 distributes the high frequency signal H generated by the frequency control section 4 to the transmitting antenna section 2 as a transmit signal S, and to the receiving circuit section 6 as a local signal L. The receiving antenna section 5 receives a reflected beam reflected from a target. The receiving circuit section 6 mixes a receive signal Ri (i=1 to 4) supplied from the receiving antenna section 5 with the local signal L supplied from the transmitting circuit section 3 to generate a beat signal Bi. The A/D converter section 7 converts the beat signal Bi to generate sample data Di. The signal processing section 8 outputs the control command C to the frequency control section 4, and obtains information regarding the target reflecting the radar beam (relative speed, distance, direction, etc.) on the basis of the sample data Di received from the A/D converter section 7.

The transmitting antenna section 2 is constituted of a single array antenna 21 having a plurality of radiating elements connected in series through a feed line. The receiving antenna section 5 is constituted of a plurality of (four in this embodiment) array antennas 51 having the similar structure as the array antenna 21.

The radar apparatus 1 is mounted on a vehicle such that the arranging direction of the radiating elements of the array antennas 21 and 51 is along the vertical direction (up/down direction) of the vehicle, and the arranging direction of the plurality of the array antennas 51 is along the horizontal direction (lateral direction) of the vehicle.

The transmitting circuit section 3 includes a divider which distributes the high frequency signal H supplied from the frequency control section 4 to the array antenna 21 and the receiving circuit section 6, and an amplifier for amplifying the high frequency signal H distributed from the divider as the transmit signal S to be fed to the array antenna 21.

The receiving circuit section 6 includes, for each of the array antennas 51 constituting the receiving antenna section 5, a mixer for mixing the receive signal Ri supplied from the corresponding array antenna 51 with the local signal L, a filter for eliminating unnecessary frequency components from the output of the mixer, and an amplifier for amplifying the output of the filter to be supplied to the A/D converter section 7 as the beat signal Bi.

Figure 1B:
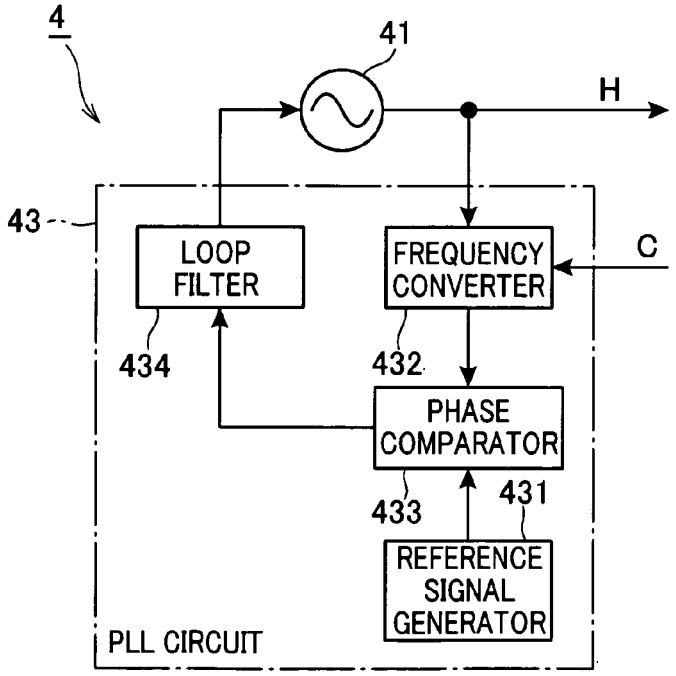
FIG. 1B is a block diagram showing the structure of a frequency control section included in the radar apparatus shown in FIG. 1A.

Each of the transmitting circuit section 3 and the receiving circuit section 6 is configured as a one-chip MMIC (Monolithic Microwave Integrated Circuit). As shown in FIG. 1B, the frequency control section 4 includes a voltage-controlled oscillator (VCO) 41, and a PLL (Phase Locked Loop) circuit 43 which controls the oscillation frequency of the VCO 41 in accordance with the output of the VCO 41 and the control command C outputted from the signal processing circuit 8.

The PLL circuit 43 includes a reference signal generator 431, a frequency converter 432, a phase comparator 433, and a loop filter 434. The reference signal generator 431 generates a reference signal having a frequency (several hundred kHz to several tens of MHz) sufficiently lower than the frequency of the high frequency signal H generated by the frequency control section 4. The frequency converter 432 frequency-divides the output of the VCO 41 at a division frequency-division ratio designated by the control command C to generate a frequency-divided signal. The phase comparator 433 outputs a signal having a pulse width depending on a phase difference between the reference signal and the frequency-divided signal. The loop filter 434 smoothes the output of the phase comparator 433 to generate a voltage signal as a control signal of the VCO 41.

The signal processing section 8 performs at least a tilt angle adjusting process to adjust the elevation angle of the radar beam at the time of mounting the radar apparatus 1 on the vehicle, and an object detecting process to obtain information (relative speed, distance, direction, etc.) of an object reflecting the radar beam on the basis of sample data obtained through transmission and reception of the radar beam when the vehicle is running.

The array antenna 21 of the transmitting antenna section 2 and the array antenna 51 of the receiving antenna section 5 have the same structure. Accordingly, explanation is given only to the structure of the array antenna 21.

Figure 2:
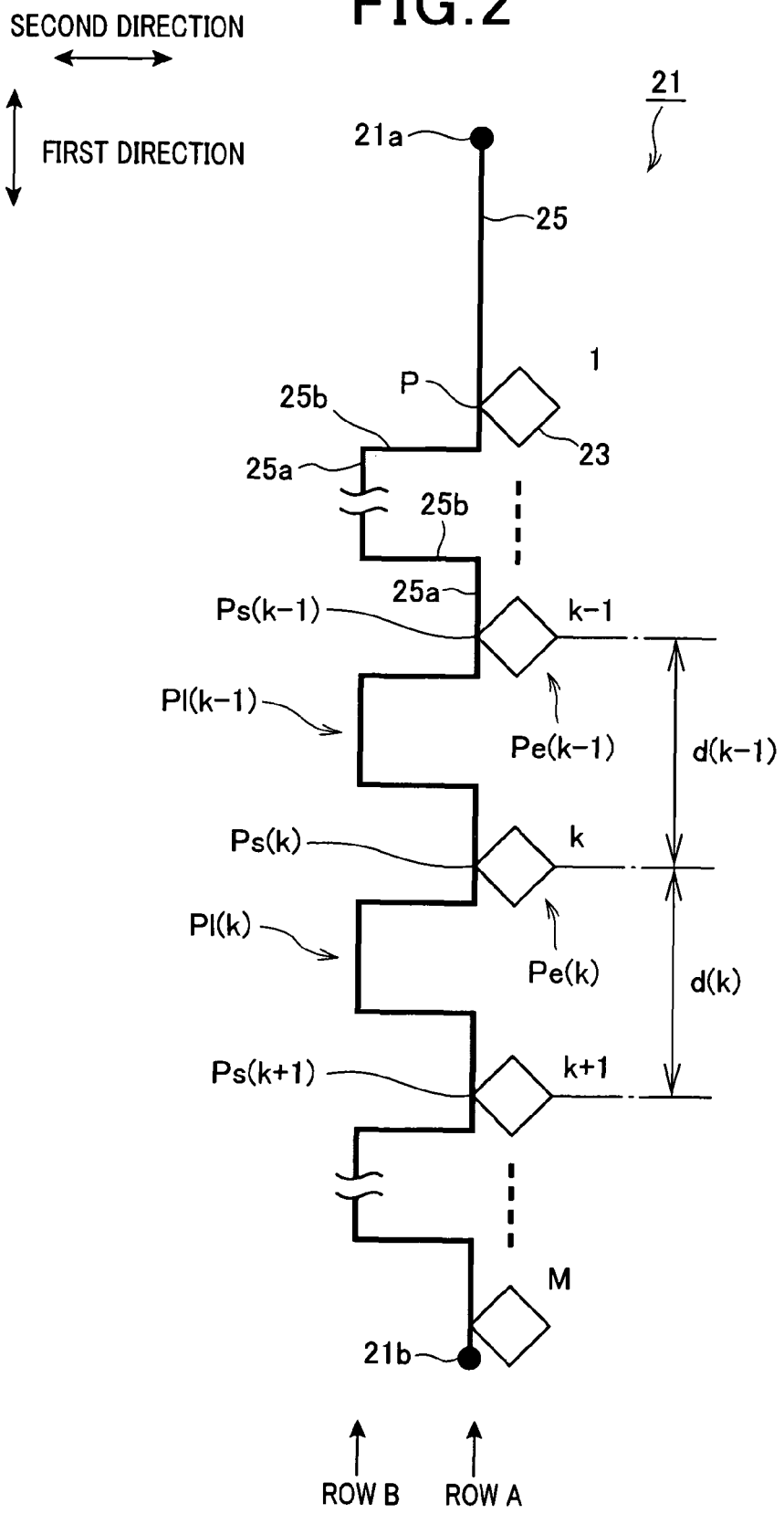
FIG. 2 is a diagram schematically showing the arrangement of radiating elements and a feed line constituting an array antenna of a first embodiment of the invention.

FIG. 2 is a diagram schematically showing an arrangement of radiating elements 23 and a feed line 25 constituting the array antenna 21. As shown in FIG. 2, the radiating elements 23 are connected in series through the feed line 25.

Each of the radiating elements 23 is a patch antenna, and the feed line 25 is a micro strip line. The feed line 25 is fed at its one end (referred to as an "antenna feed point" hereinafter) 21*a*, the other end (referred to as an "antenna termination point" hereinafter) 21*b* being terminated with a resistor (not shown) to prevent signal reflection. Accordingly, the array antenna 21 is configured as a traveling-wave fed array antenna.

The feed line 25 is laid in a shape of a series of cranks. The feed line 25 is constituted of a first partial feed line group including partial feed lines 25*a* disposed in two rows (row A and row B) extending along the arranging direction of the radiating elements 23 (referred to as the first direction hereinafter), and a second partial feed line group including partial feed lines 25*b* extending in the direction perpendicular to the arranging direction of the radiating elements 23 (referred to as the second direction hereinafter) and series-connecting the partial feed lines 25*a*.

The respective radiating elements 23 are fed from the partial feed lines 25*a* belonging to the first partial feed line group and located on one of the two rows (the row A in this embodiment). In the following, a connection point between each respective radiating element 23 and the feed line 25 may be referred to as an "element feed point".

Here, it is assumed that the number of the radiating elements 23 is M, k (=1, 2, 3, . . . M) being used as an identifier to identify the positions (the positional numbers from the antenna feed point 21a) of the radiating elements 23, d(k) representing an arranging interval between the kth radiating element 23 and the (k+1)th radiating element 23. Since the radiating elements 23 are disposed at regular intervals of D, D=d(1)=d(2)=. . . d(M-1).

In this embodiment, the arranging interval D is set equal to the on-line wavelength λg of a fed signal having a frequency equal to the center frequency f0 (76.5 GHz) of the usage frequency band (76 GHz to 77 GHz) of the radar apparatus 1.

When the frequency of the fed signal is equal to the center frequency f0 and the phase of the fed signal at the element feed point P of the first radiating element is a reference phase, the phase difference ΔP between the element feed point of the kth radiating element and the element feed point of the (k+1) th radiating element is given by the following equation (1), where Ps(k) is the phase of the fed signal at the element feed point of the kth radiating element, Pe(k) is a phase shift (a delay amount of the phase) depending on the characteristic of the kth radiating element, and Pl(*k*) is a phase shift depending on the inter-element line length as a length of the feed line between the kth radiating element and the (k+1)th radiating element.

$$\Delta P = Ps(k+1) - Ps(k) \quad (1)$$
$$= Pe(k) + Pl(k)$$

When the frequency of the fed signal is equal to the center frequency f0, the inter-element line length DL which makes this phase difference ΔP equal to 2nπ [rad] (n being a natural number) is given by the following equation (2).

$$DL = Pl(k)/2\pi\cdot\lambda g$$

$$\text{where } Pl(k) = 2n\pi - Pe(k) \quad (2)$$

This embodiment is configured such that the phase difference ΔP is equal to 6π, that is, n is equal to 3.

Accordingly, the direction of the radar beam is along a line normal to the plane of the array antenna 21 when the frequency of the fed signal is equal to the center frequency f0, tilts to the antenna feed point 21*a* along the first direction with the decrease of the frequency (with the increase of the wavelength λg), and tilts to the antenna termination point 21*b* with the increase of the frequency along the first direction(with the decrease of the wavelength λg).

Figure 3A:
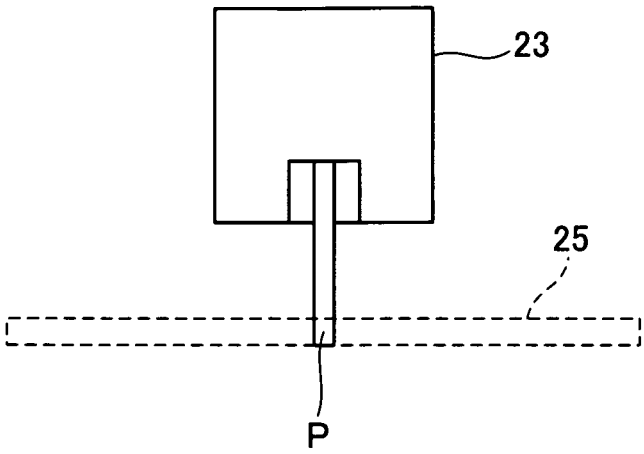
FIGS. 3A and 3B are diagrams showing patterns of the radiating element.
Figure 3B:
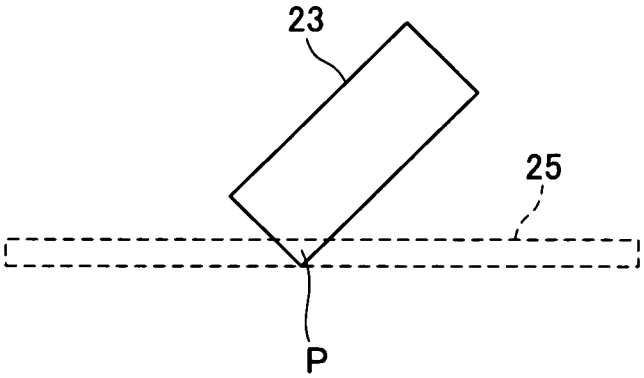

Accordingly, the signal processing section 8 performs frequency control of the fed signal, that is, performs frequency-division ratio control in accordance with a desired frequency in order to adjust the tilt angle. When the radiating elements 23 have a structure as shown in FIG. 3A in which reflection therefrom to the respective element feed points P is small, the inter-element line length DL can be calculated by letting Pe(k) =0in the equation (2). On the other hand, when the radiating elements 23 have a structure as shown in FIG. 3B in which reflection therefrom to the respective element feed points P is large, the inter-element line length DL becomes long compared to the case where Pe(k) can be regarded to be 0.

FIG. 4A is a table showing the phases of the fed signal at the element feed points P of (k+1) th and (k+2)th radiating elements 23 for three different frequencies of the fed signal with respect to the phase of the fed signal at the element feed point P of the kth radiating element 23, for each of the conventional radar apparatus in which the interval D of the radiating elements is equal to λg and the feed line is laid straight (DL=λg), and the radar apparatus of this embodiment (DL=3λg).

FIG. 4B is a graph showing variation of the tilt angle with the variation of the frequency of the fed signal in this embodiment, and FIG. 4C is a graph showing variation of the tilt angle with the variation of the frequency of the fed signal in the conventional radar apparatus. As seen from these graphs, the variation of the phase at the respective element feed points P with the variation of the frequency in this embodiment is three times that of the convention radar apparatus.

It is also seen from these graphs that the variation of the phase when the frequency of the fed signal is varied over the entire usage range (76 GHz to 77 GHz) is only approximately 2° (approximately ±1°) with respect to the phase at the center frequency of f0) in the conventional radar apparatus, while on the other hand, it is as large as approximately 6° (approximately ±3°) in this embodiment.

As explained above, the radar apparatus 1 of this embodiment is configured such that in each of the array antenna 21 constituting the transmitting antenna section 2 and the array antennas 51 constituting the receiving antenna section 5, the feed line 25 is not laid straight but laid in a shape of a series of cranks so that the inter-element line length DL between each two succeeding radiating elements can be lengthened.

Accordingly, according to this embodiment, it is possible to increase the inter-element line length DL and accordingly the phase variation without increasing the arranging interval D of the radiating elements. Since this configuration increases the variation of the direction of the radar beam with the variation of the frequency of the fed signal, this embodiment makes it possible to vary the direction of the radar beam to a large extent in spite of the narrow usage band width without increasing the size and circuit scale of the radar apparatus.

Second Embodiment

Next, a second embodiment of the invention is described. Since the second embodiment differs from the first embodiment only in that the transmitting antenna section 2 and the receiving antenna section 5 are constituted of array antennas 121, the following description focuses on the structure of the array antenna 121.

Figure 5A:
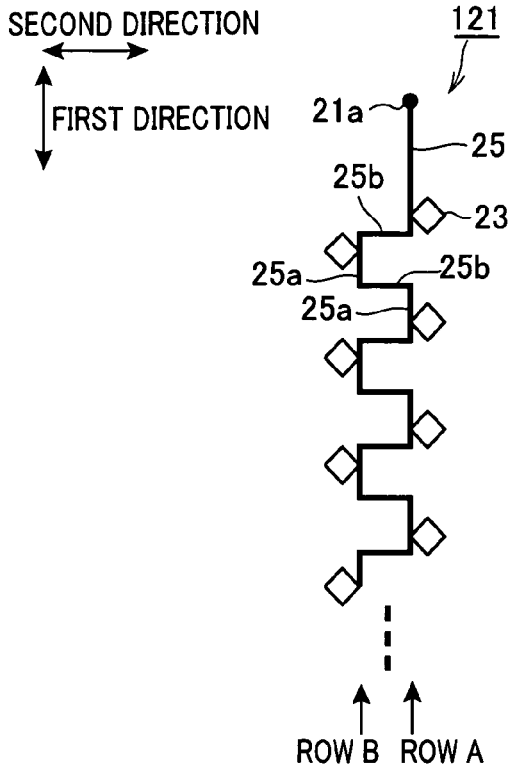
FIG. 5A is a diagram schematically showing an arrangement of radiating elements and a feed line constituting an array antenna of a second embodiment of the invention.

FIG. 5A is a diagram schematically showing the arrangement of the radiating elements 23 and feed line 25 constituting the array antenna 121 of the second embodiment. As shown in FIG. 5A, the feed line 25 in this embodiment has the same configuration as that in the first embodiment.

In the first embodiment, the radiating elements 23 are arranged in a row extending along the first direction, and fed from the partial feed lines 25*a* on the row A which constitute the first partial feed line group together with the row B. On the other hand, in the second embodiment, the radiating elements 23 are arranged in two rows extending along the first direction, and fed from both of the row A and row B of the partial feed lines 25*a* belonging to the first partial feed line group.

The radiating elements 23 are disposed such that the phase shift amount of the fed signal at the element feed points P of the respective radiating elements 23 increase in proportion to the distance from the radiating element 23 closest to the antenna feed point 21*a*.

Figure 5B:
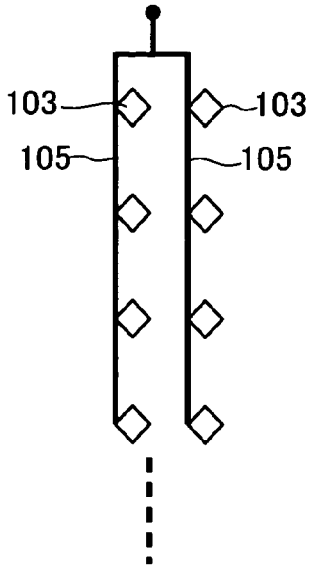
FIG. 5B is a diagram for explaining the performance of the array antenna of the second embodiment of the invention.

The radar apparatus 1 of the second embodiment provides the same advantages as those provided by the radar apparatus 1 of the first embodiment, and in addition, provides the advantage that it can transmit the radar beam at a radiant intensity equivalent to that obtained by the configuration shown in FIG. 5B in which two sets of array antennas in each of which the radiating elements 103 are series-connected through the straight feed line 105 are provided side by side.

Although, in this embodiment, the radiating elements 23 fed from the row B of the partial feed lines 25*a* belonging to the first partial feed line group are disposed outside the feed line 25 (on the left side of the row B in FIG. 5A), they may be disposed inside the feed line 25 (on the right side of the row Bin FIG. 5A). Likewise, the radiating elements 23 fed from the row A of the partial feed lines 25*a* may be disposed inside the feed line 25 (on the left side of the row A in FIG. 5A) instead of outside the feed line 25 (on the right side of the row A in FIG. 5A).

Third Embodiment

Next, a third embodiment of the invention is described. Since the third embodiment differs from the first embodiment only in that the transmitting antenna section 2 and the receiving antenna section 5 are constituted of array antennas 221, the following description focuses on the structure of the array antenna 221.

Figure 6A:
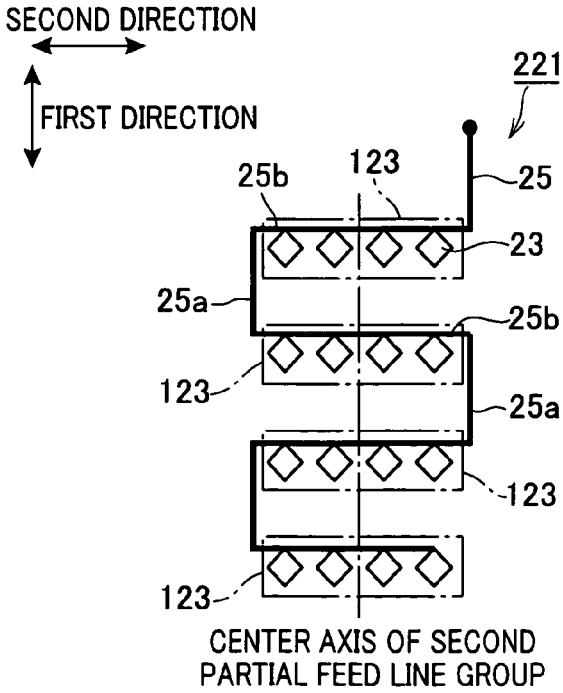
FIG. 6A is a diagram schematically showing an arrangement of radiating elements and a feed line constituting an array antenna of a third embodiment of the invention.

FIG. 6A is a diagram schematically showing the arrangement of the radiating elements 23 and the feed line 25 constituting the array antenna 221 of this embodiment. As shown in this figure, the feed line 25 of the array antenna 221 is laid in a shape of a series of cranks as in the case of the first embodiment. However, in this embodiment, the length of the respective partial feed lines 25*a* belonging to the first partial feed line group is set equal to λg, while the length of the respective partial feed lines 25*b* belonging to the second partial feed line group is set equal to 3λg.

Further, each of the partial feed lines 25*b* belonging to the second partial feed line group is connected with a radiating element section 123 constituted of a plurality of (four, in this embodiment) radiating elements 23. The radiating elements 23 constituting the radiating element section 123 are disposed line-symmetrically with respect to the center axis of the partial feed lines 25*b*. That is, in this embodiment, the radiating elements 23 are disposed in 4 rows extending in the first direction. In the array antenna 221 having the above configuration, the partial feed lines 25*b* belonging to the second partial feed line group alternate in the direction of propagation of the fed signal along their positions in the first direction. Accordingly, the radiating element sections 123 can be divided into two groups in accordance with the feed directions of their partial feed lines 25*b*.

When the frequency of the fed signal is changed, the directions of the beams respectively generated by these two groups of the radiating element sections 123 change by the same amount but oppositely along the second direction. Accordingly, the combined beam of the beams generated by theses groups points to the front direction, because the tilts of these beams are cancelled out in the second direction.

Further, since the inter-element line length between each adjacent radiating element sections 123 arranged in the first direction is 4λg on average, when the frequency of the fed signal is changed, the beams generated by the respective radiating element sections 123 change in the same orientation along the first direction by the same amount.

Figure 6B:
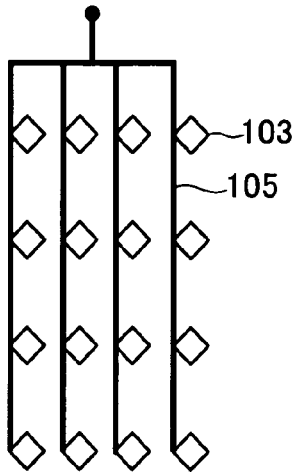
FIG. 6B is diagram for explaining the performance of the array antenna of the third embodiment of the invention.

Accordingly, according to the radar apparatus 1 of this embodiment, in addition to the advantages obtained by the first embodiment, there is provided an advantage that it can transmit a radar beam at a radiant intensity equivalent to that obtained by the configuration shown in FIG. 6B in which four sets of the array antennas each including the radiating elements 103 series-connected through the straight feed line 105 are arranged side by side.

Although the radiating element section 123 is constituted of a plurality of the radiating elements 23, it may be constituted by only one radiating element 23.

Figure 10A:
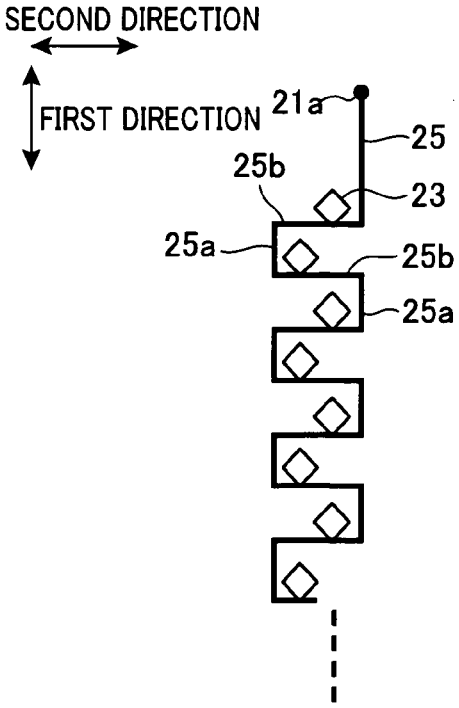
FIG. 10A is a diagram showing a modification of the array antenna of the third embodiment of the invention.

In this case, the radiating elements 23 fed from the partial feed lines 25*b* may be disposed in a row, or may be disposed in two rows such that the radiating elements 23 which belong to the same group with regard to their feed directions are on the same row, for example, as shown in FIG. 10A.

In any of the above configurations of this embodiment, the radiating elements 23 are disposed such that the phase shift amounts of the fed signal at the element feed points P of the respective radiating elements 23 increase in proportion to the distance from the radiating element 23 closest to the antenna feed point 21*a*.

Figure 10B:
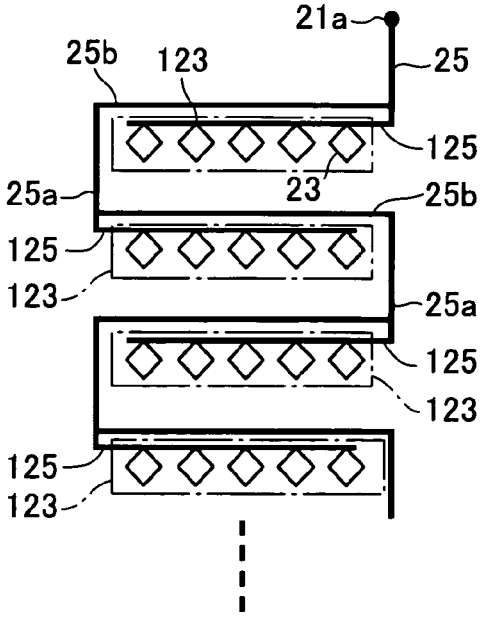
FIG. 10B is a diagram for explaining the performance of the modification of the array antenna of the third embodiment of the invention.

In this embodiment, the radiating elements 23 constituting the radiating element section 123 are connected so as to be fed directly from the partial feed lines 25*b*. However, when the radiating element section 123 is constituted of only one radiating element 23, the radiating element 23 may be connected to a branch line 125 branching from its element feed point and extending along the partial feed line 25*b* to be fed from this branch line 125 (cf. FIG. 10B).

Fourth Embodiment

Next, a fourth embodiment of the invention is described. Since the fourth embodiment differs from the first embodiment only in that the transmitting antenna section 2 and the receiving antenna section 5 are constituted of array antennas 321, the following description focuses on the structure of the array antenna 321.

Figure 7A:
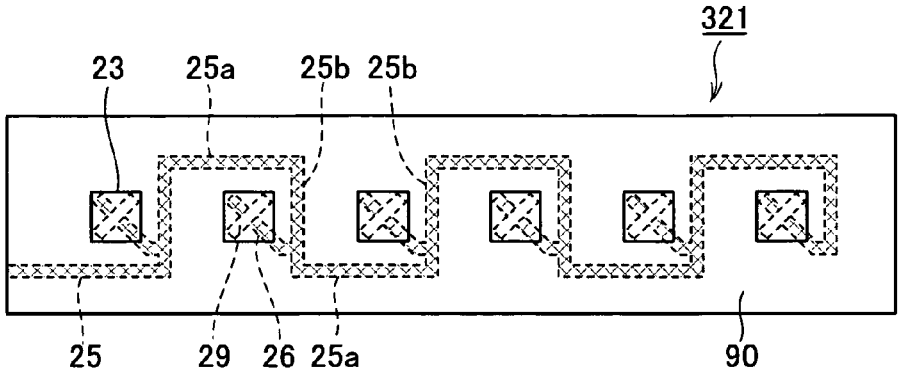
FIG. 7A is a plan view of an array antenna of a fourth embodiment of the invention.
Figure 7B:
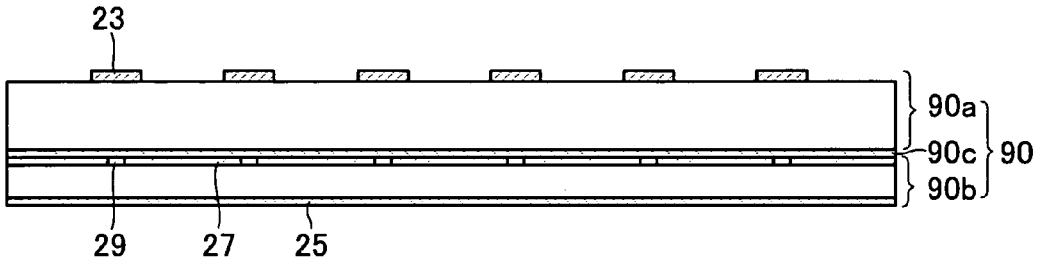
FIG. 7B is a cross-sectional view of the array antenna of the fourth embodiment of the invention.
Figure 7C:
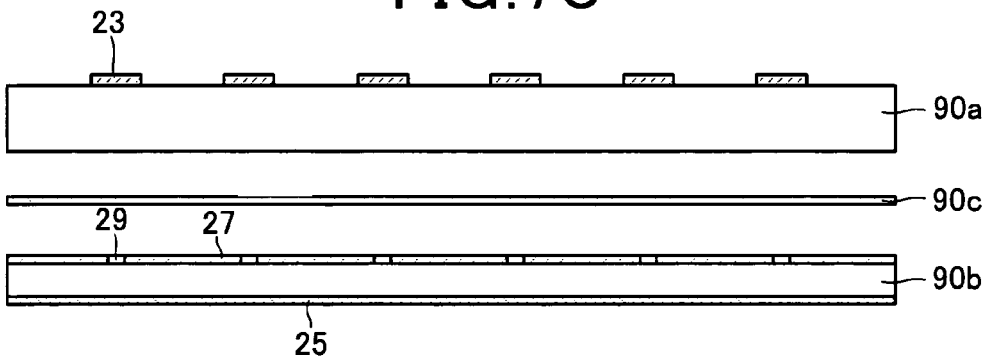
FIG. 7C is an exploded view of the array antenna of the fourth embodiment of the invention.
Figure 8A:
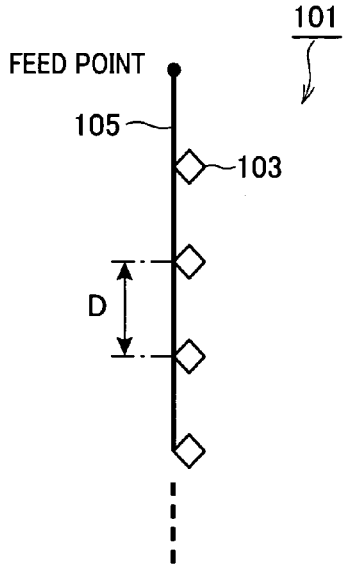
FIGS. 8A and 8B are diagrams explaining the structure and problem of a conventional array antenna.
Figure 8B:
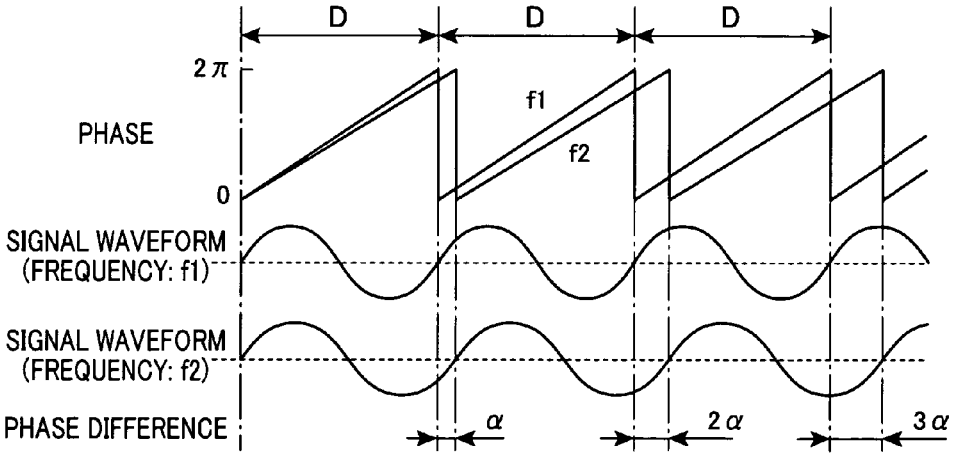
Figure 9:
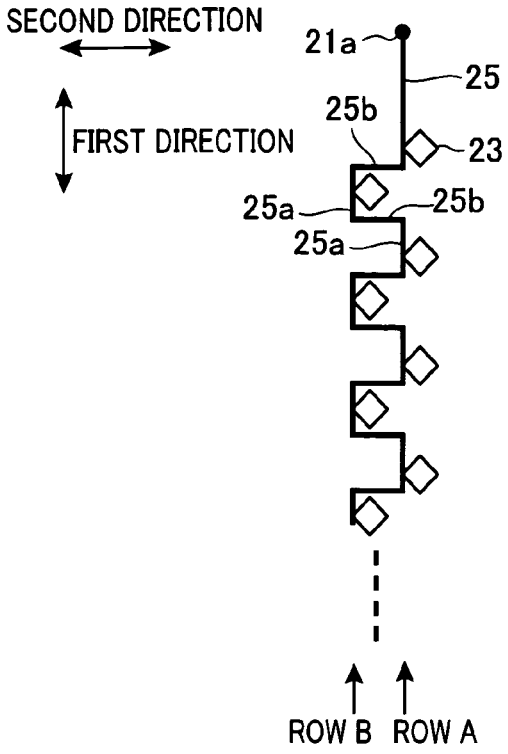
FIG. 9 is a diagram showing a modification of the array antenna of the second embodiment of the invention.

FIG. 7A is a plan view of the array antenna 321, FIG. 7B is a cross-sectional view of the array antenna 321, and FIG. 7C is an exploded view of the array antenna 321. As shown in these figures, the array antenna 321 is constituted of a multilayer substrate including a single-sided dielectric substrate 90*a* and a double-sided dielectric substrate 90*b* adhered to each other by a bonding film 90*c*. The single-sided dielectric substrate 90*a* is formed with a plurality of the radiating elements 23 having a square shape pattern and arranged in a row at regular intervals along the first direction at one surface thereof. The double-sided dielectric substrate 90*b* is formed with the feed line 25 laid in a shape of a series of cranks on one surface thereof, and formed with a ground plane 27 and feed slots 29 on the other surface thereof.

Each of the feed slots 29, which is an opening of a rectangular shape formed in the ground plane 27, is located opposite to the radiating element 23 so as to extend along the diagonal line of the radiating element 23. On the surface on which the feed line 25 is formed, patterns 26 having approximately the same size as the openings of the feed slots 29 are formed so as to extend respectively along the diagonal lines of the radiating element 23 and cross the feed slots 29. The patterns 26 are connected respectively to the corresponding partial feed lines 25*b* belonging to the second partial feed line group. That is, in this embodiment, the radiating elements 23 are fed from the partial feed lines 25*b* through the patterns 26 and the feed slots 29.

Since the array antenna 321 of this embodiment is made of the multi-layer substrate 90, and the radiating elements 23 and the feed line 25 are respectively formed in different layers, it is possible to increase the design flexibility of the feed line 25.

The pattern layer on which the feed line 25 is formed may have a larger dielectric constant than that of the pattern layer on which the radiating elements 23 are formed. In this case, since the inter-element line length can be shortened, the space needed to lay the feed line 25 can be reduced. Further, in this case, the radar beam direction can be varied further wider than when the inter-element line length is not shortened. Further, in this case, when a plurality of the array antennas are arranged in the second direction, the arranging interval can be shortened.

It is a matter of course that various modifications can be made to the above embodiments as described below.

In the above embodiments, the arranging interval of the radiating elements 23 and the inter-element line length between In the above embodiments, the arranging interval of the radiating elements 23 and the inter-element line length between each successive two radiating elements 23 are constant for all of the radiating elements 23. However, the arranging interval and the inter-element line length may not be constant, if the phase shift of the fed signal varies in proportion to the distance along the first direction from a reference one of the radiating elements 23.

In the above embodiments, the arranging interval of the radiating elements 23 is set equal to the on-line wavelength $\lambda g$ of the fed signal having the center frequency of f0. However, in view of eliminating the grating effect, it is preferable to set the arranging interval smaller than half the free-space wavelength $\lambda 0/2$ of the fed signal having the center frequency of f0.

In the above embodiments, the array antenna 21 constituting the transmitting antenna section 2 and the array antennas 51 constituting the receiving antenna section 5 have the same structure. However, they may have different structures. For example, it is possible that the radar apparatus of the invention has a receiving antenna section constituted of array antennas having the same structure as the array antenna 51 (or 21) used in the first embodiment, and a transmitting antenna section constituted of an array antenna having the same structure as the array antenna 121 used in the second embodiment, or the array antenna 221 used in the third embodiment. However, it is preferable that the variation of the tilt angle with the variation of the frequency of the fed signal is the same for both the transmitting antenna section and the receiving antenna section.

To increase the phase shift in the feed line 25, the slow-wave structure disclosed, for example, in Japanese patent Application Laid-open No. 2007-306290 may be adopted.

The above explained preferred embodiments are exemplary of the invention of the present application which is described solely by the claims appended below. It should be understood that modifications of the preferred embodiments may be made as would occur to one of skill in the art.

What is claimed is:

1. A radar apparatus comprising:

a transmitting antenna section to transmit a radar beam when supplied with a transmit signal;

a receiving antenna section to receive the radar beam reflected from an object and output a receive signal;

a signal generating section to generate the transmit signal to be supplied to the transmitting antenna section; and a signal processing section to process the receive signal outputted from the receiving antenna section in order to obtain information on the object;

wherein each of the transmitting antenna section and the receiving antenna section include at least one array antenna and the radar apparatus further includes a frequency control section to control a frequency of the transmit signal; and wherein the at least one array antenna comprises:

a feed line; and a plurality of radiating element sections arranged at a predetermined arranging interval in a first direction, each of the radiating element sections including at least one radiating element fed a traveling wave through the feed line;

wherein an inter-element line length as a length of the feed line between each succeeding two of the radiating element sections is longer than the arranging interval;

the feed line is laid in a shape of a series of cranks, and is constituted of a first partial feed line group including a plurality of first partial feed lines each extending in the first direction and disposed in first and second rows along the first direction, and a second partial feed line group including a plurality of second partial feed lines each extending in a second direction perpendicular to the first direction to series-connect the first partial feed lines;

each of the radiating element sections includes a branch line separate from and branching from the feed line, the radiating elements of which being arranged along the branch line to be fed from the branch line; and each of the radiating element sections has one of a first structure in which the radiating elements thereof are fed in succession in a first orientation along the second direction and a second structure in which the radiating elements thereof are fed in succession in a second orientation opposite to the first orientation along the second direction, the radiating element sections having the first structure and the radiating element sections having the second structure being disposed alternately along the first direction.

2. The radar apparatus according to claim 1, wherein the radiating elements are disposed respectively in at least two different positions with respect to the second direction.

3. The radar apparatus according to claim 2, wherein each of the first partial feed lines is connected with a corresponding one of the radiating elements in order that the radiating elements are fed from the first partial feed line group for each of the first and second rows.

4. The radar apparatus according to claim 2, wherein each of the radiating element sections includes two or more of the radiating elements arranged along a corresponding one of the second partial feed lines and fed from the second partial feed line group.

5. The radar apparatus according to claim 1, wherein the radiating element sections are arranged along the first row to be fed from the first partial feed lines belonging to the first partial feed line group.

6. The radar apparatus according to claim 1, wherein each of the radiating elements is fed from a corresponding one of the second partial feed lines belonging to the second partial feed line group.

7. The radar apparatus according to claim 1, wherein the inter-element line length is shorter than a half of a free-space wavelength of a signal to be transmitted from or received in the array antenna.

8. The radar apparatus according to claim 1, wherein the arranging interval is equal to an on-line wavelength of a signal having a center frequency of a usage frequency band of the array antenna, and the inter-element line length is equal to n (n being an integer larger than or equal to 2) times a summation of a phase shift over each inter-element line length and a phase shift of the signal in each radiating element section.

9. The radar apparatus according to claim 1, wherein each of the radiating elements has a configuration in which there occurs a phase delay at a feed point thereof due to signal reflection thereof.

10. The radar apparatus according to claim 1, wherein the radiating element sections and the feed line are formed on the same pattern layer of a substrate.

11. The radar apparatus according to claim 1, wherein the radiating element sections and the feed line are formed respectively on different pattern layers of a substrate.

12. The radar apparatus according to claim 11, wherein a dielectric constant of the pattern layer on which the feed line is formed is larger than that of the pattern layer on which the radiating element sections are formed.

13. The radar apparatus according to claim 1, wherein the frequency control section includes a PLL circuit which performs feedback control on a frequency of the transmit signal.

14. The radar apparatus according to claim 1, wherein the transmitting antenna section and the receiving antenna section are mounted on a vehicle such that elevation angles thereof are along the first direction.

15. The radar apparatus according to claim 1, wherein each of the second partial feed lines is connected to two or more of the radiating elements.

16. The radar apparatus according to claim 1, wherein the branch line of each of the radiating sections extends along a respective second partial feed line.

17. A radar apparatus comprising:

a transmitting antenna section to transmit a radar beam when supplied with a transmit signal;

a receiving antenna section to receive the radar beam reflected from an object and output a receive signal;

a signal generating section to generate the transmit signal to be supplied to the transmitting antenna section; and a signal processing section to process the receive signal outputted from the receiving antenna section in order to obtain information on the object;

wherein each of the transmitting antenna section and the receiving antenna section include at least one array antenna and the radar apparatus further includes a frequency control section to control a frequency of the transmit signal; and wherein the at least one array antenna comprises:

a feed line; and a plurality of radiating element sections arranged at a predetermined arranging interval in a first direction, each of the radiating element sections including at least one radiating element fed a traveling wave through the feed line;

wherein an inter-element line length as a length of the feed line between each succeeding two of the radiating element sections is longer than the arranging interval;

the feed line is laid in a shape of a series of cranks, and is constituted of a first partial feed line group including a plurality of first partial feed lines each extending in the first direction and disposed in first and second rows along the first direction, and a second partial feed line group including a plurality of second partial feed lines each extending in a second direction perpendicular to the first direction to series-connect the first partial feed lines;

each of the radiating element sections includes a branch line separate from and branching from the feed line, the radiating elements of which being arranged along the branch line to be fed from the branch line; and each of the radiating element sections has one of a first structure in which the radiating elements thereof are fed in succession in a first orientation along the second direction and a second structure in which the radiating elements thereof are fed in succession in a second orientation opposite to the first orientation along the second direction, the radiating element sections having the first structure and the radiating element sections having the second structure being disposed alternately along the first direction.

18. The radar apparatus according to claim 17, wherein each of the second partial feed lines is connected to two or more of the radiating elements.

19. The radar apparatus according to claim 17, wherein the branch line of each of the radiating sections extends along a respective second partial feed line.

20. A radar apparatus comprising:

a transmitting antenna section to transmit a radar beam when supplied with a transmit signal;

a receiving antenna section to receive the radar beam reflected from an object and output a receive signal;

a signal generating section to generate the transmit signal to be supplied to the transmitting antenna section; and a signal processing section to process the receive signal outputted from the receiving antenna section in order to obtain information on the object;

wherein each of the transmitting antenna section and the receiving antenna section include at least one array antenna and the radar apparatus further includes a frequency control section to control a frequency of the transmit signal; and wherein the at least one array antenna comprises:

a feed line; and a plurality of radiating element sections arranged at a predetermined arranging interval in a first direction, each of the radiating element sections including at least one radiating element fed a traveling wave through the feed line;

wherein an inter-element line length as a length of the feed line between each succeeding two of the radiating element sections is longer than the arranging interval;

the feed line is laid in a shape of a series of cranks, and is constituted of a first partial feed line group including a plurality of first partial feed lines each extending in the first direction and disposed in first and second rows along the first direction, and a second partial feed line group including a plurality of second partial feed lines each extending in a second direction perpendicular to the first direction to series-connect the first partial feed lines;

each of the radiating element sections includes a branch line separate from and branching from the feed line, the radiating elements of which being arranged along the branch line to be fed from the branch line; and each of the radiating element sections has one of a first structure in which the radiating elements thereof are fed in succession in a first orientation along the second direction and a second structure in which the radiating elements thereof are fed in succession in a second orientation opposite to the first orientation along the second direction, the radiating element sections having the first structure and the radiating element sections having the second structure being disposed alternately along the first direction.

21. The radar apparatus according to claim 20, wherein each of the second partial feed lines is connected to two or more of the radiating elements.

22. The radar apparatus according to claim 20, wherein the branch line of each of the radiating sections extends along a respective second partial feed line.

* * * * *

UNITED STATES PATENT AND TRADEMARK OFFICE

CERTIFICATE OF CORRECTION

PATENT NO. : 8,471,775 B2
APPLICATION NO. : 12/661383
DATED : June 25, 2013
INVENTOR(S) : Nakabayashi et al.

It is certified that error appears in the above-identified patent and that said Letters Patent is hereby corrected as shown below:

Delete the title page and substitute therefore with the attached title page showing the corrected number of claims.

In the Claims

Col. 11, line 39 - col. 13, line 12, delete claims 17-22.

Signed and Sealed this
Twenty-second Day of April, 2014

Michelle K. Lee

Michelle K. Lee
*Deputy Director of the United States Patent and Trademark Office*

(12) United States Patent
Nakabayashi et al.

(10) Patent No.: US 8,471,775 B2
(45) Date of Patent: Jun. 25, 2013

(54) ARRAY ANTENNA AND RADAR APPARATUS

(75) Inventors: Kento Nakabayashi, Anjo (JP); Kazuma Natsume, Oobu (JP); Yuu Watanabe, Toyota (JP); Takuya Kouya, Nagoya (JP)

(73) Assignee: Denso Corporation, Kariya (JP)

( * ) Notice: Subject to any disclaimer, the term of this patent is extended or adjusted under 35 U.S.C. 154(b) by 365 days.

(21) Appl. No.: 12/661,383

(22) Filed: Mar. 16, 2010

(65) Prior Publication Data

US 2010/0238067 A1 Sep. 23, 2010

(30) Foreign Application Priority Data

Mar. 18, 2009 (JP) ..... 2009-065910

(51) Int. Cl.
*H01Q 11/02* (2006.01)

(52) U.S. Cl.
USPC ..... 343/731; 342/70

(58) Field of Classification Search
USPC ..... 342/70; 343/731
See application file for complete search history.

(56) References Cited

U.S. PATENT DOCUMENTS 5,367,307 A * 11/1994 Dupuis et al. ..... 343/700 MS
6,424,298 B1 * 7/2002 Nishikawa et al. .... 343/700 MS
2002/0004692 A1 * 1/2002 Nicosia et al. ..... 701/16
2003/0184477 A1 * 10/2003 Shafai et al. ..... 343/700 MS
2004/0145513 A1 * 7/2004 Katayama et al. ..... 342/70
2005/0285773 A1 * 12/2005 Hartzstein et al. ..... 342/70

FOREIGN PATENT DOCUMENTS

| | | |
|---|---|---|
| JP | 06-112725 | 4/1994 |
| JP | 07-086826 | 3/1995 |
| JP | 08-097620 | 4/1996 |
| JP | 08-186436 | 7/1996 |
| JP | 2001-044752 | 2/2001 |
| JP | 2006-064628 | 3/2006 |
| JP | 2006-279525 | 10/2006 |
| JP | 2008-014643 | 1/2008 |
| JP | 2008-151583 | 7/2008 |

OTHER PUBLICATIONS

Office Action dated Jan. 18, 2011 from corresponding Japanese Patent Application No. 2009-065910 with English translation.

* cited by examiner

*Primary Examiner* — Timothy A Brainard
(74) *Attorney, Agent, or Firm* — Harness, Dickey & Pierce, PLC

(57) ABSTRACT

The array antenna includes a feed line, and a plurality of radiating element sections arranged at a predetermined arranging interval in a first direction, each of the radiating element sections including at least one radiating element fed a traveling wave through the feed line. The inter-element line length as a length of the feed line between each succeeding two of the radiating element sections is longer than the arranging interval in the first direction.

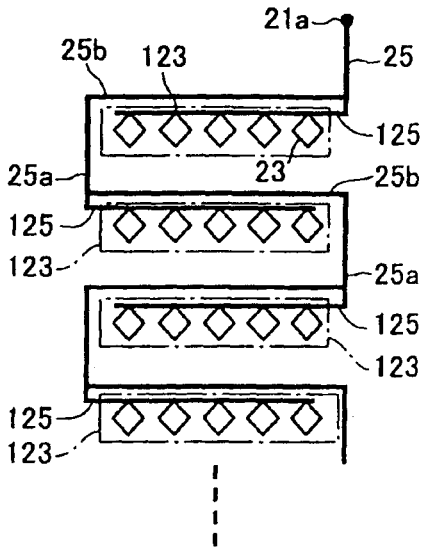

16 Claims, 8 Drawing Sheets